US008262751B2

(12) United States Patent
Biswas et al.

(10) Patent No.: US 8,262,751 B2
(45) Date of Patent: Sep. 11, 2012

(54) DEVELOPMENT OF A TECHNO-ECONOMIC PROCESS FOR ORGANO REFINING OF COAL

(75) Inventors: Pinakpani Biswas, Jamshedpur (IN); Vimal Kumar Chandaliya, Jamshedpur (IN); Pradip Kumar Banerjee, Jamshedpur (IN)

(73) Assignee: Tata Steel Limited, Jamshedpur (IN)

( * ) Notice: Subject to any disclaimer, the term of this patent is extended or adjusted under 35 U.S.C. 154(b) by 201 days.

(21) Appl. No.: 12/681,701

(22) PCT Filed: Jun. 5, 2009

(86) PCT No.: PCT/IN2009/000326

§ 371 (c)(1),
(2), (4) Date: Aug. 23, 2010

(87) PCT Pub. No.: WO2010/029563

PCT Pub. Date: Mar. 18, 2010

(65) Prior Publication Data

US 2010/0307054 A1 Dec. 9, 2010

(30) Foreign Application Priority Data

Sep. 12, 2008 (IN) ..... 1581/KOL/08

(51) Int. Cl.
*C10L 9/02* (2006.01)
*C10L 9/10* (2006.01)

(52) U.S. Cl. ..... 44/627; 44/621; 44/624; 44/505

(58) Field of Classification Search ..... 44/620, 44/621, 624, 626, 627
See application file for complete search history.

(56) References Cited

U.S. PATENT DOCUMENTS 4,272,356 A * 6/1981 Stiller et al. ..... 208/424
4,380,454 A 4/1983 Stadelhofer et al.

FOREIGN PATENT DOCUMENTS

DE 2951116 A1 7/1981
JP 59027984 A 2/1984

OTHER PUBLICATIONS

Studies on Design of a Process for Organo Refining of Coal to Obtain Super Clean Coal by C.S. Sharma and D.K. Sharma, Energy Sources 21:663-668 (1999).*

* cited by examiner

*Primary Examiner* — Cephia D Toomer
*Assistant Examiner* — Pamela H Weiss
(74) *Attorney, Agent, or Firm* — The Webb Law Firm

(57) ABSTRACT

An improved organo-refining process to produce low ash clean coal from high ash coal, comprising: mixing coal, solvent and a co-solvent to produce a slurry; feeding the slurry to a reactor by pumping; extracting a coal-solvent mixture from the reactor; feeding the extracted mixture to a flasher unit; recovering about 30% of the solvent from the flashing unit; feeding the remaining heavy material to an evaporator; extracting about 60% of solvent from the evaporator; discharging the residue from the evaporator to a precipitator having water which produces a coal slurry; filtering the slurry in a rotary drum; collecting the super clean coal as a residue and feeding the filtrate into a distillation unit; and separating the water and the organic material in the filtrate to recover at least 7 to 8% of the remaining solvent.

3 Claims, 1 Drawing Sheet

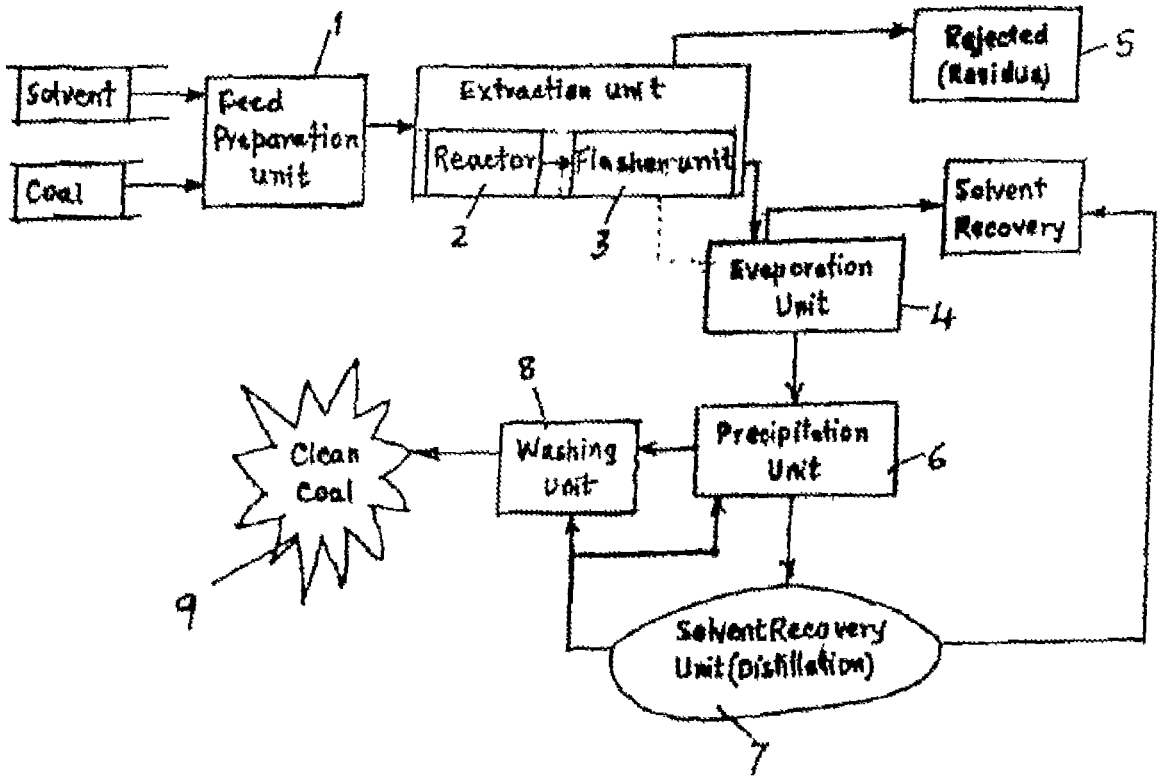
Solvent
Coal
Feed Preparation unit
1
Extraction unit
Reactor
Flasher unit
2
3
Rejected (Residue)
5
Solvent Recovery
Evaporation Unit
4
Precipitation Unit
6
Washing unit
8
Clean Coal
9
Solvent Recovery Unit (Distillation)
7

DEVELOPMENT OF A TECHNO-ECONOMIC PROCESS FOR ORGANO REFINING OF COAL

BACKGROUND OF THE INVENTION

1. Field of Invention

The present invention relates to an improved organo-refining process to produce low ash clean coal from high ash coals used for metallurgical applications.

2. Description of Related Art

The existing process to produce low ash clean coal from high ash coals comprises a step of chemical beneficiation of the coal by dissolving organic matter of coal in various organic solvents. As the coal basically constitutes a heterogeneous mixture of organic and inorganic constituents, a process of solvolysis of coal varies depending on its constituents, maturity and structural characteristics. The main advantages of the chemical benefication process are i) ease of recovery of the solvent from the main process stream, ii) solvolytic efficiency of the recovered solvents is as high as that of a fresh solvent, iii) 95-98% recovery of the solvent, iv) improved coking properties of clean coal, and v) availability of industrial organic solvents. However, the operating cost of this process is substantially high because of high cost of the solvents and energy requirement in the process.

Organo-refining, or solvent-refining, or, solvent extraction of coal is a well-known process technology. However, the primary objective in most of the existing processes is to produce ultra clean coal or super clean coal with ash contains less than 4%. Incidentally, the average content of this parent coal (Run of Mine) is 25%. Exploratory study revealed that it is possible to extract at least 50% of the parent coal through this studied process of extraction albeit under reflux conditions at atmospheric pressure. The processed coal contains almost 4% ash.

The yield and the ash content of the super clean coal when produced by the studied process as described hereinabove, is also observed to be satisfactory. In a bench scale set up to carry-out the studied process, the main concerning factor apart from yield is the economic viability of the studied process, for example, a substantially higher consumption of heat for extraction. Again, recovery of the solvent has warrants high consumption of heat. Combination of the above two heat inputs prima-facie drives the studied process towards infeasibility. Now, if the two heat consumptions are arranged on priority basis, then heat consumption for the extraction supersedes, as the extraction process solely depends upon the extraction temperature, this is why it is often called as thermal extraction. Thus, the heat requirement for solvent recovery is the only possibility for minimization of total heat consumption. Accordingly, an effective or optimized design of solvent recovery could convert the studied process as a feasible one.

SUMMARY OF THE INVENTION

It is therefore an object of the invention to propose an improved process to produce low ash clean coal from high ash coal, which eliminates the disadvantages of prior art.

Another object of the present invention is to propose an improved process to produce low ash clean coal from high ash coal is economical.

A further object of the present invention is to propose an improved process to produce low ash clean coal from high ash coal, which is flexible so as to enable production of clean coal with desired level of ash content.

A still further object of the present invention is to propose an improved process to produce low ash clean coal from high ash coal, which is less fire hazardous.

An yet further object of the present invention is to propose an improved process to produce low ash clean coal from high ash coal, which consumes less energy.

Accordingly, there is provided an improved process to produce low ash clean coal from high ash coal. The process comprises mixing of coal, solvent and co-solvent thoroughly to produce coal slurry. The coal slurry is extracted with a predetermined ratio of coal-solvent mixture. In an extraction unit designed for implementation of the process, a sufficient high temperature is maintained to facilitate the extraction at high temperature. A high pressure is also maintained to elevate the boiling point of the liquid. The variation of temperature and pressure range is around (200° C. to 300° C.) and (1.5 atm. to 5 atm.). Due to thermal impact, the coal structure is relaxed and the extraction process gets enhanced. Now keeping the pressure and temperature inside the reactor constant, a sufficient time is given to settle down the heavy mineral matter of the coal slurry. After settling of the mineral matter, around 80% of coal extract is taken out from the top portion, keeping the pressure and temperature constant. The coal extract is then released in a flasher unit at atmospheric pressure. Due to the pressure drop, at least 30% of the solvent gets flashed out leaving a 70% of liquid at the bottom of the flash chamber, which is then transferred to an evaporator. In the evaporator, a further recovery of the solvent is made and the concentrate of the heavy material is then discharged into a precipitation tank. The combination of the evaporator and flash unit enables almost 90% of solvent recovery. The rest of the solvent, which is still 7-8% in amount, can be recovered from a distillation unit. Thus, the improved, process provides a desired yield with minimum energy consumption.

BRIEF DESCRIPTION OF THE DRAWING

FIG. 1 shows a process flow chart of the invention.

DETAILED DESCRIPTION OF THE INVENTION

As shown in FIG. 1, coal, solvent like N-methyl pyrollidone and co-solvent like Ethyl diamine are mixed thoroughly in a feed preparation zone (1) of a system designed for implementation of the improved process. The coal slurry is then pumped into a reactor (2). In the reactor (2), a temperature around 200° C. to 300° C. is maintained by circulating hot thermic fluid. A high pressure is maintained by inducing a pressure about 3 to 4 atm. inside the reactor (2). The high pressure elevates the boiling point of the solvent. Residence time of the coal slurry in the reactor (2) may vary from 1 hr to 1.5 hrs depending on the techno economic parameters of the process and its specific requirement. The extracted coal-solvent mixture is then allowed to be settled in the reactor (2). In the settler (2), after residence of the coal-solvent mixture for some specified time, all mineral matters are settled. The coal extract is collected from the top of the settler (2) and sent to a flasher unit (3). In the flasher unit (3) due to a sudden pressure drop, around 30% of the solvent gets boiled off as the temperature of the solvent is much higher than the atmospheric boiling point of the solvent. Thus, around 30% of the solvent are recovered without introducing any external heat source. Actually high pressure and temperature are employed in the reactor (2) for flashing. The heavy material with some coal extracts is then fed to an evaporator (4). Bottom part of the flasher unit (3) also contains some amount of coal extract which is again discharged into the evaporator (4). The residue (5) is taken off and stored for later use. The filtrate contains little but some coal extracts which is fed to the evaporator (4). In the evaporator (4), the "coal extract" is concentrated by boiling most of the solvent. With the help of evaporation, a further solvent recovery around 60% is possible. This way almost 90% of the solvent recovery is possible by the combination of the flasher (3) and the evaporation unit (4). In a precipitating tank (6), coal is precipitated as water acts as an anti-solvent. This slurry becomes filtered by another rotary drum filter and the super clean coal is collected as the residue. The filtrate contains water and organic mixture which is fed to a distillation unit (7) and water and organic material is separated. In the distillation unit (7), the remaining 7 to 8% of the solvent is recovered. The proposed process helps to recover 98% of the solvent by combination of the flash unit (3), evaporation unit (4) and distillation unit (7) with minimum energy consumption. The process simultaneously, produces clean coal of desired ash level (0.1 to 10%) with a satisfactory yield (9).

We claim:

1. An improved organo-refining process to produce low ash clean coal from high ash coal, in particular suitable for metallurgical applications, the method comprising the steps of:

mixing coal, solvent and a co-solvent thoroughly in a system designed to implement the process, the mixing being taken-up to produce a coal slurry in a feed preparation zone of the system;

feeding the slurry to a reactor by pumping, wherein the reactor maintains a temperature of about 200° C. to 300° C. and a pressure of 1.5 atm. to 5 atm.;

allowing a residence time of the coal-solvent slurry in the reactor of about 1 hr to 1.5 hr depending upon predetermined process parameters;

extracting a coal-solvent mixture after having settled the slurry in the reactor;

feeding the extracted coal to a flasher unit;

recovering about 30% of the solvent from the flashing unit, the remainder being a heavy material;

feeding the remaining heavy material with some coal extracts including some amount of coal extract left at the bottom part of the flashing unit to an evaporator;

extracting about 60% of solvent from the evaporator, the remainder being a residue;

discharging the residue from the evaporator to a precipitator having water which acts as an anti-solvent to produce a coal slurry;

filtering the slurry in a rotary drum to produce a super clean coal residue and a filtrate;

collecting the super clean coal residue containing 0.1 to 10% ash;

feeding the filtrate containing water and an organic material mixture into a distillation unit; and separating the water and the organic material in the distillation unit, in order to recover at least 7 to 8% of the remaining solvent.

2. The process according to claim 1, wherein the initial coal slurry mixture contains coal:solvent:co-solvent in the proportion of 1:17:1.

3. The process according to claim 1, wherein organic chemicals N-methyl pyrollidone and ethyl diamine are used as the solvent and the co-solvent for extraction.

* * * * *

UNITED STATES PATENT AND TRADEMARK OFFICE

CERTIFICATE OF CORRECTION

PATENT NO. : 8,262,751 B2
APPLICATION NO. : 12/681701
DATED : September 11, 2012
INVENTOR(S) : Pinakpani Biswas et al.

It is certified that error appears in the above-identified patent and that said Letters Patent is hereby corrected as shown below:

Column 4, Line 29, Claim 3, delete "pyrollidone" and insert -- pyrrolidone --

Signed and Sealed this
First Day of January, 2013

David J. Kappos

David J. Kappos
*Director of the United States Patent and Trademark Office*